US006945337B2

(12) United States Patent
Kawai et al.

(10) Patent No.: US 6,945,337 B2
(45) Date of Patent: Sep. 20, 2005

(54) POWER IMPACT TOOL

(75) Inventors: Kozo Kawai, Neyagawa (JP); Yoshinori Sainomoto, Sanda (JP); Tatsuhiko Matsumoto, Habikino (JP); Tadashi Arimura, Kyoto (JP); Toshiharu Ohashi, Sakata-gun (JP); Hiroshi Miyazaki, Hikone (JP); Hidenori Shimizu, Hikone (JP); Fumiaki Sawano, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/962,565

(22) Filed: Oct. 13, 2004

(65) Prior Publication Data

US 2005/0109519 A1 May 26, 2005

(30) Foreign Application Priority Data

Oct. 14, 2003 (JP) ..... 2003-354197

(51) Int. Cl.[7] ..... B25B 21/02; B25B 23/145

(52) U.S. Cl. ..... 173/183; 173/2; 173/176; 173/181

(58) Field of Search ..... 173/2, 176, 178, 173/180, 181, 182, 177, 183; 73/862.23, 73/862.24, 862.25

(56) References Cited

U.S. PATENT DOCUMENTS 4,316,512 A * 2/1982 Kibblewhite et al. ..... 173/183
5,285,857 A * 2/1994 Shimada ..... 173/1
5,402,688 A * 4/1995 Okada et al. ..... 73/862.23
5,457,866 A * 10/1995 Noda ..... 29/407.02
5,544,534 A * 8/1996 Fujitaka ..... 73/862.23
6,161,629 A * 12/2000 Hohmann et al. ..... 173/181
6,371,218 B1 * 4/2002 Amano et al. ..... 173/183
6,761,229 B2 * 7/2004 Cripe et al. ..... 173/176

FOREIGN PATENT DOCUMENTS

| | | |
|---|---|---|
| JP | 4-322974 | 11/1992 |
| JP | 6-91551 | 4/1994 |
| JP | 9-285974 | 11/1997 |
| JP | 2000-354976 | 12/2000 |
| JP | 2001-277146 | 10/2001 |

OTHER PUBLICATIONS

English Language Abstract of 6-91551.
English Language Abstract of 4-322974.

(Continued)

*Primary Examiner*—Scott A. Smith
(74) *Attorney, Agent, or Firm*—Greenblum & Bernstein, P.L.C.

(57) ABSTRACT

In a power impact tool for fastening a fastening member, a torque for fastening the fastening member can be estimated without using a high-resolution sensor and a high-speed processor. The power impact tool comprises a rotation speed sensor for sensing a rotation speed of a driving shaft of a motor with using a rotation angle of the driving shaft, a rotation angle sensor for sensing a rotation angle of an output shaft to which a bit is fitted in a term between an impact of a hammer to next impact of the hammer, a torque estimator for calculating an impact energy with using an average rotation speed of the driving shaft and for calculating a value of estimated torque for fastening the fastening member which is given as a division of the impact energy by the rotation angle of the output shaft, a torque setter for setting a reference value of torque to be compared, and a controller for stopping the driving of the motor when the value of the estimated torque becomes equal to or larger than a predetermined reference value set by the torque setter.

9 Claims, 8 Drawing Sheets

OTHER PUBLICATIONS

English Language Abstract of 9-285974.
English Language Abstract of 2000-354976.
English Language Abstract of 2001-277143.
U.S. Appl. No. 10/962,621, Kawai et al.
U.S. Appl. No. 10/924,979, Kawai et al.

* cited by examiner

FIG. 7
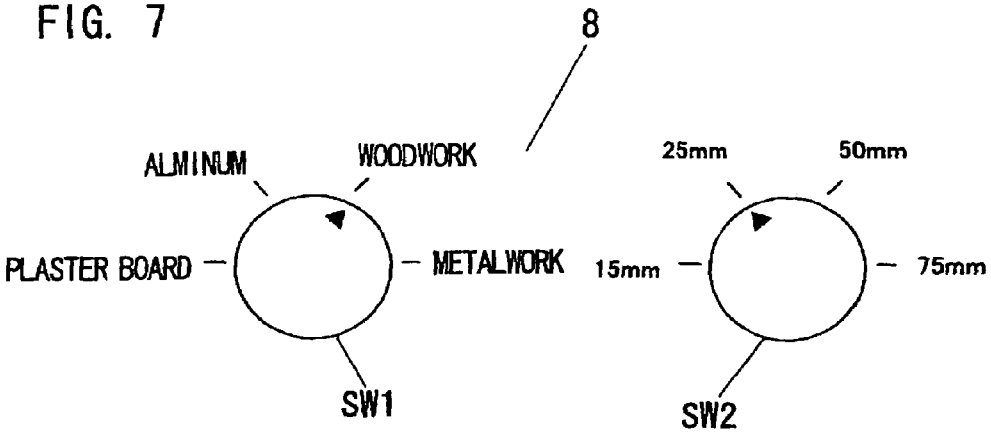
FIG. 8
| | 15mm | 25mm | 50mm | 75mm |
|---|---|---|---|---|
| PLASTER BOARD | 1 | 1 | 2 | 2 |
| ALMINUM | 1 | 2 | 3 | 4 |
| WOODWORK | 2 | 4 | 6 | 8 |
| METALWORK | 3 | 5 | 7 | 9 |
FIG. 9
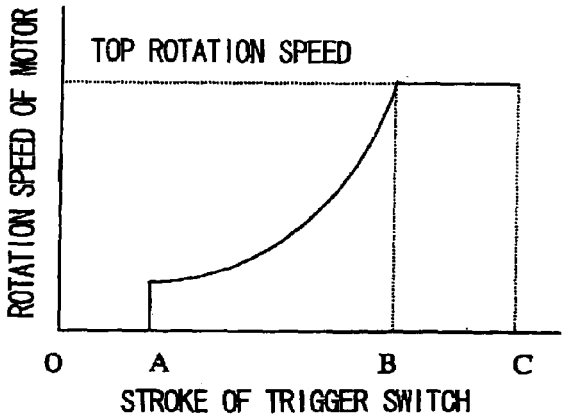

POWER IMPACT TOOL

BACKGROUND OF THE INVENTION

1. Field of the Invention

The present invention relates to a power impact tool such as an impact driver or an impact wrench used for fastening a fastening member such as a bolt or a nut.

2. Description of the Related Art

In a power impact tool used for fastening a fastening member such as a bolt or a nut, it is preferable that a fastening operation is automatically completed by stopping the driving of a driving source such as a motor, when a torque for fastening the fastening member reaches to a predetermined reference value previously set.

In a first conventional power impact tool shown in publication gazette of Japanese Patent Application 6-91551, an actual torque, which is necessary for fastening the fastening member, is sensed and the driving of a motor is stopped when the actual torque reaches to a predetermined reference value. The first conventional power impact tool which stops the driving of the motor corresponding to the actual torque for fastening the fastening member needs a sensor provided on an output shaft for sensing the actual torque, so that it causes the cost increase and the damage of the usability owing to the upsizing of the power impact tool, even though the automatic stopping of the driving of the motor can be controlled precisely corresponding to the actual torque.

In a second conventional power impact tool, for example, shown in publication gazette of Japanese Patent Application 4-322974, a number of impact of a hammer is sensed and driving of a motor is automatically stopped when the number of impact reaches to a predetermined reference number, which is previously set or calculated from a torque inclination after the fastening member is completely fastened. The second conventional power impact tool, however, has a disadvantage that a large difference may occur between a desired torque and the actual torque for fastening the fastening member, even though the control for stopping the motor can easily be carried out. The difference causes loosening of the fastening member due to insufficient torque when the actual torque is much smaller than the desired torque. Alternatively, the difference causes to damage the component to be fastened by the fastening member or to damage a head of the fastening member due to superfluous torque when the actual torque is much larger than the desired torque.

In a third conventional power impact tool shown in publication gazette of Japanese Patent Application 9-285974, a rotation angle of a fastening member per each impact is sensed and driving of a motor is stopped when the rotation angle becomes less than a predetermined reference angle. Since the rotation angle of the fastening member per each impact is inversely proportional to the torque for fastening the fastening member, it controls the fastening operation corresponding to the torque for fastening the fastening member, in theory. The power impact tool using a battery as a power source, however, has a disadvantage that the torque for fastening the fastening member largely varies due to the drop of voltage of the battery. Furthermore, the torque for fastening the fastening member is largely affected by the hardening of a material of a component to be fastened by the fastening member.

For solving the above-mentioned problems, in a fourth conventional power impact tool shown in publication gazette of Japanese Patent Application 2000-354976, an impact energy and a rotation angle of the fastening member per each impact are sensed, and the driving of the motor is stopped when a torque for fastening the fastening member calculated with using the energy and the rotation angle becomes equal to or larger than a predetermined reference value. The impact energy is calculated with using a rotation speed of the output shaft at the moment when the output shaft is impacted, or a rotation speed of a driving shaft of the motor just after the impact. Since the fourth conventional power impact tool senses the impact energy based on an instantaneous speed at the impact occurs, it needs a high-resolution sensor and a high-speed processor, which is the cause of expensiveness.

SUMMARY OF THE INVENTION

A purpose of the present invention is to provide a low cost power impact tool used for fastening a fastening member, by which the torque for fastening the fastening member can precisely be estimated without using the high-resolution sensor and the high-speed processor.

A power impact tool in accordance with an aspect of the present invention comprises:

- a hammer;
- a driving mechanism for rotating the hammer around a driving shaft;
- an output shaft to which a rotation force owing to an impact of the hammer is applied;
- an impact sensor for sensing occurrence of the impact of the hammer;
- a rotation speed sensor for sensing a rotation speed of the driving shaft with using a rotation angle of the driving shaft;
- a rotation angle sensor for sensing a rotation angle of the output shaft in a term from a time when the impact sensor senses an occurrence of the impact of the hammer to another time when the impact sensor senses a next occurrence of the impact of the hammer;
- a torque estimator for calculating an impact energy with using an average rotation speed of the driving shaft sensed by the rotation speed sensor, and for calculating a value of estimated torque for fastening a fastening member which is given as a division of the impact energy by the rotation angle of the output shaft;
- a torque setter for setting a reference value of torque to be compared; and
- a controller for stopping the rotation of the driving shaft when the value of the estimated torque becomes equal to or larger than a predetermined reference value set by the torque setter.

By such a configuration, the impact energy, which is necessary for calculating the value of the estimated torque, can be calculated with using the average rotation speed of the driving shaft between the impacts of the hammer, without using the high-resolution sensor and the high-speed processor. Thus, the estimation of the torque for fastening the fastening member can be calculated by using an inexpensive microprocessor.

BRIEF DESCRIPTION OF THE DRAWINGS

FIG. 7 is a front view of still another example of the torque setter having two rotary switches and dials thereof respectively for selecting a size of a fastening member such as a bolt or a nut and a kind of a material of a component to be fastened by the fastening member;

FIG. 8 is a table showing an example of the levels of the reference value of the torque to be compared corresponding to the materials of the component to be fastened and the size of the fastening member;

FIG. 9 is a graph showing an example of a relation between a rotation speed of the motor and a stroke of a trigger switch operated by a user;

DETAILED DESCRIPTION OF THE EMBODIMENT

Figure 1:
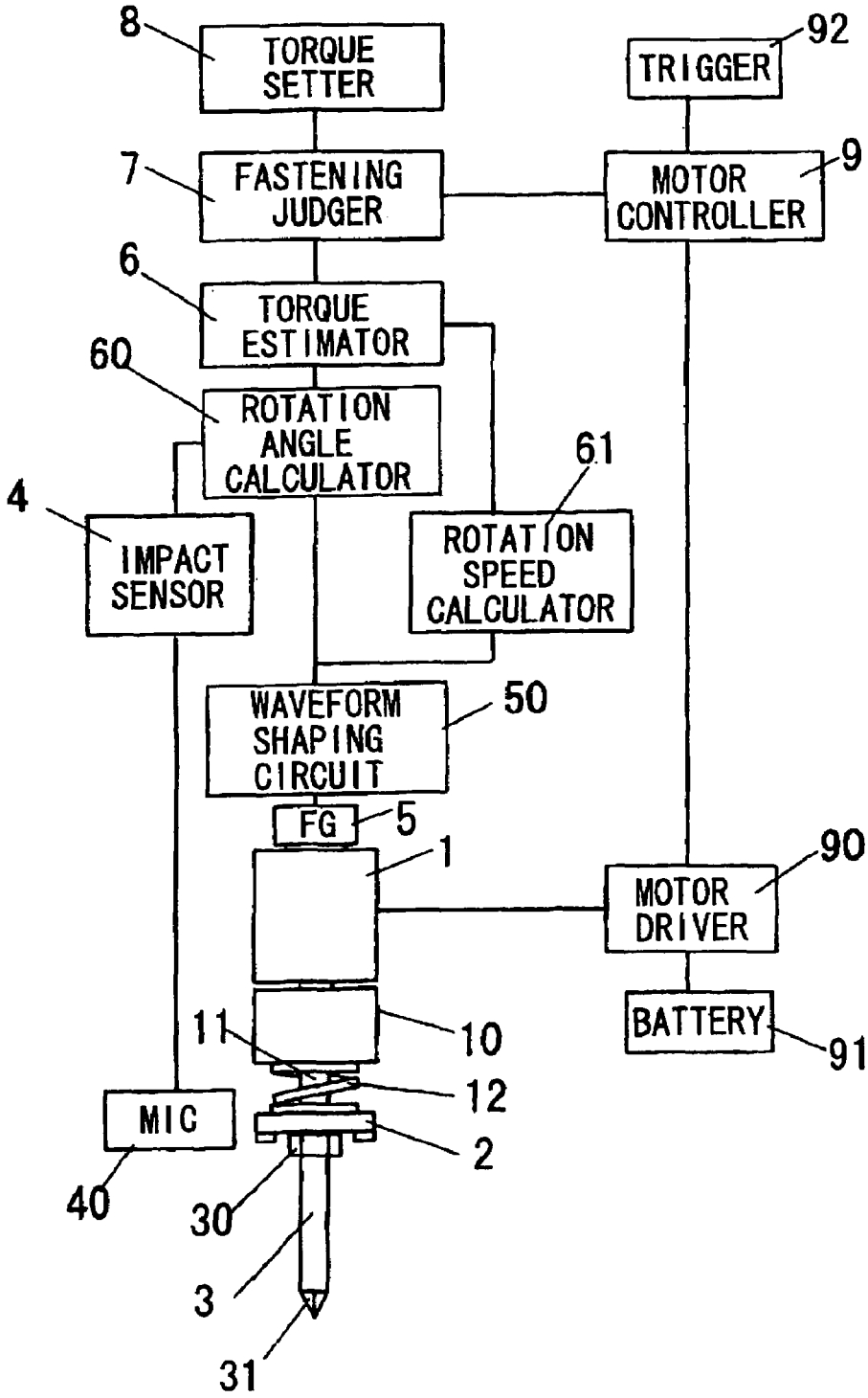
FIG. 1 is a block diagram showing a configuration of a power impact tool in accordance with an embodiment of the present invention.

A power impact tool in accordance with an embodiment of the present invention is described. FIG. 1 shows a configuration of the power impact tool in this embodiment.

The power impact tool comprises a motor 1 for generating a driving force, a reducer 10 having a predetermined reduction ratio and for transmitting the driving force of the motor 1 to a driving shaft 11, a hammer 2 engaged with the driving shaft 11 via a spline bearing, an anvil 30 engaged with the driving shaft 11 with a clutch mechanism, and a spring 12 for applying pressing force to the hammer 2 toward the anvil 30. The motol 1, the reducer 10, the driving shaft 11, and so on constitute a driving mechanism.

The hammer 2 can be moved in an axial direction of the driving shaft 11 via the spline bearing, and rotated with the driving shaft 11. The clutch mechanism is provided between the hammer 2 and the anvil 30. The hammer 2 is pressed to the anvil 30 by the pressing force of the spring 12 in an initial state. The anvil 30 is fixed on an output shaft 3. A bit 31 is detachably fitted to the output shaft 3 at an end thereof. Thus, the bit 31 and the output shaft 3 can be rotated with the driving shaft 11, the hammer 2 and the anvil 30 by the driving force of the motor 1.

When no load is applied to the output shaft 3, the hammer 2 and the output shaft 3 are integrally rotated with each other. Alternatively, when a load larger than a predetermined value is applied to the output shaft 3, the hammer 2 moves upward against the pressing force of the spring 12. When the engagement of the hammer 2 with the anvil 30 is released, the hammer 2 starts to move downward with rotation, so that the hammer 2 impacts the anvil 30 in the rotation direction thereof. Thus, the output shaft 3 on which the anvil 30 is fixed can be rotated.

A pair of cam faces is formed on, for example, an upper face of the anvil 30 and a lower face of the hammer 2, which serve as the cam mechanism. For example, when the fastening member has been fastened and the rotation of the output shaft 3 is stopped, the cam face on the hammer 2 slips on the cam face on the anvil 30 owing to the rotation with the driving shaft 11 and the hammer 2 moves in a direction depart from the anvil 30 along the driving shaft 11 following to the elevation of the cam faces against the pressing force of the spring 12. When the hammer 2 goes around, for example, substantially one revolution, the restriction due to the cam faces is suddenly released, so that the hammer 2 impacts the anvil 30 owing to charged pressing force of the spring 12 while it is rotated with the driving shaft 11. Thus, a powerful fastening force can be applied to the output shaft 3 via the anvil 30, since the mass of the hammer 2 is much larger than that of the anvil 30. By repeating the impact of the hammer 2 against the anvil 30 in the rotation direction, the fastening member can be fastened completely with a necessary fastening torque.

The motor 1 is driven by a motor driver 90 so as to start and stop the rotation of the shaft. The motor driver 90 is further connected to a motor controller 9, to which a signal corresponding to a displacement (stroke or pressing depth) of a trigger switch 92 is inputted. The motor controller 9 judges the user's intention to start or to stop the driving of the motor 1 corresponding to the signal outputted from the trigger switch 92, and outputs a control signal for starting or stopping the driving of the motor 1 to the motor driver 90.

The motor driver 90 is constituted as an analogous power circuit using a power transistor, and so on for supplying large electric current to the motor 1 stably. A rechargeable battery 91 is connected to the motor driver 90 for supplying electric power to the motor 1. On the other hand, the motor controller 9 is constituted by, for example, a CPU (Central Processing Unit), a ROM (Read Only Memory) and a RAM (Random Access Memory) for generating the control signals corresponding to a control program.

The power impact tool further comprises a frequency generator (FG) 5 for outputting pulse signals corresponding to the rotation of the driving shaft 11, and a microphone 40 for sensing an impact boom due to the impact of the hammer 2 on the anvil 30. An output of the microphone 40 is inputted to an impact sensor 4, which senses or judges the occurrence of the impact corresponding to the output of the microphone 40.

The output signals of the frequency generator 5 are inputted to a rotation angle calculator 60 and a rotation speed calculator 61 via a waveform shaping circuit 50 so as to be executed the filtering process. The rotation angle calculator 60 and the rotation speed calculator 61 are further connected to a torque estimator 6. Furthermore, the torque estimator 6 is connected to a fastening judger 7, and a torque setter 8 is connected to the fastening judger 7 for setting a reference value of a torque to be compared.

The torque estimator 6 estimates a torque for fastening the fastening member at the moment based on the outputs from the rotation angle calculator 60 and the rotation speed calculator 61, and outputs the estimated value of the torque to the fastening judger 7. The fastening judger 7 compares the estimated value of the torque at the moment with the reference value set by the torque setter 8. When the estimated value of the torque becomes larger than the reference value, the fastening judger 7 judges that the fastening member is completely fastened, and outputs a predetermined signal for stopping the driving of the motor 1 to the motor controller 9. The motor controller 9 stops the driving of the motor 1 via the motor driver 90.

The rotation angle calculator 60 is constituted for calculating a rotation angle Δr of the anvil 30 (or the output shaft 3) between an impact of the hammer 2 and a next impact of the hammer 2 with using the rotation angle ΔRM of the driving shaft 11, which is obtained from the output of the frequency generator 5, instead of directly sensing the rotation angle Δr of the anvil 30.

Specifically, the reduction ratio of the reducer 10 from the rotation shaft of the motor 1 to the output shaft 3 is designated by a symbol K, and an idling rotation angle of the hammer 2 is designated by a symbol RI, the rotation angle Δr of the anvil 30 between the impacts of the hammer 2 is calculated by the following equation.

$$\Delta r=(\Delta RM/K)-RI$$

For example, the idling rotation angle RI becomes 2π/2 when the hammer 2 impacts the anvil 30 twice in one rotation of the driving shaft, and 2π/3 when the hammer 2 impacts the anvil 30 thrice in one rotation of the driving shaft.

The torque estimator 6 calculates a value of the estimated torque T at the moment with using the following equation, when a moment of inertia of the anvil 30 (with the output shaft 3) is designated by a symbol J, an average rotation speed of the anvil 30 between the impacts of the hammer 2 is designated by a symbol ω, and a coefficient for converting to the impact energy.

$$T=(J\times C1\times\omega^2)/(2\times\Delta r)$$

Hereupon, the average rotation speed ω can be calculated as a division of a number of pulses in the output from the frequency generator 5 by a term between two impacts of the hammer 2.

According to this embodiment, it is possible to estimate the value of the torque for fastening the fastening member at the moment only by counting a term between the impacts of the hammer 2 and the number of the pulses in the output signal outputted from the frequency generator 5, with using no high-speed processor. Thus, a standard one-chip microprocessor having a timer and a counter can be used for carrying out the torque control of the motor 1.

Figure 2:
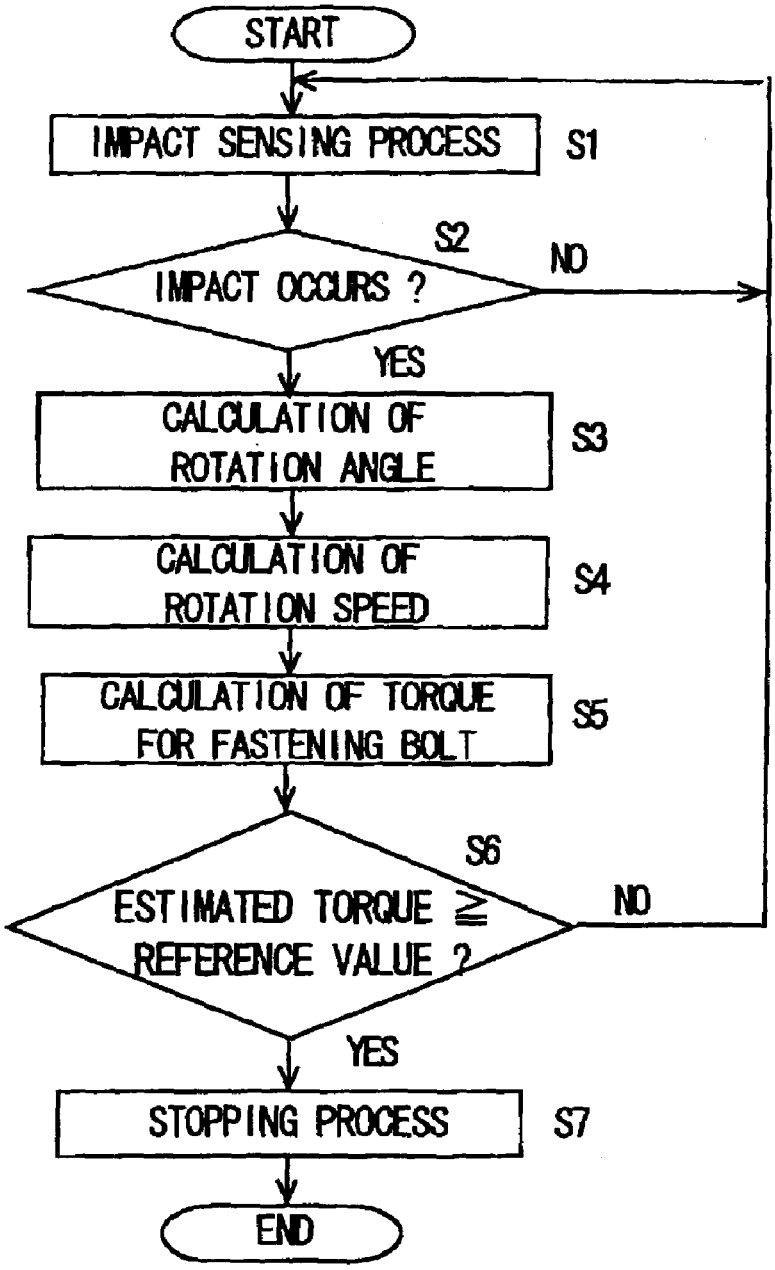
FIG. 2 is a flowchart for showing an operation of the power impact tool in the embodiment.

FIG. 2 shows a basic flow of the fastening operation of the power impact tool in this embodiment.

When the user operates the trigger switch 92, the motor controller 9 outputs a control signal for starting the driving of the motor 1 so as to fasten the fastening member. The impact sensor 4 starts to sense the occurrence of the impact of the hammer 2 (S1). When the impact sensor 4 senses the occurrence of the impact (Yes in S2), the rotation angle calculator 60 calculates the rotation angle Δr of the anvil 30 while the hammer 2 impacts the anvil 30 (S3). The rotation speed calculator 61 calculates the rotation speed ω of the driving shaft 11 of the motor 1 at the occurrence of the impact (S4). When the rotation angle Δr and the rotation speed ω are calculated, the torque estimator 6 calculates the value the estimated torque T according to the above-mentioned equation (S5). The fastening judger 7 compares the calculated value of the estimated torque T with the reference value set in the torque setter 8 (S6). When the value of the estimated torque T is smaller than the reference value (Yes in S6), the steps S1 to S6 are executed repeatedly. Alternatively, when the value of the estimated torque T becomes equal to or larger than the reference value (No in S6), the fastening judger 7 executes the stopping process for stopping the driving of the motor 1 (S7).

Figure 3:
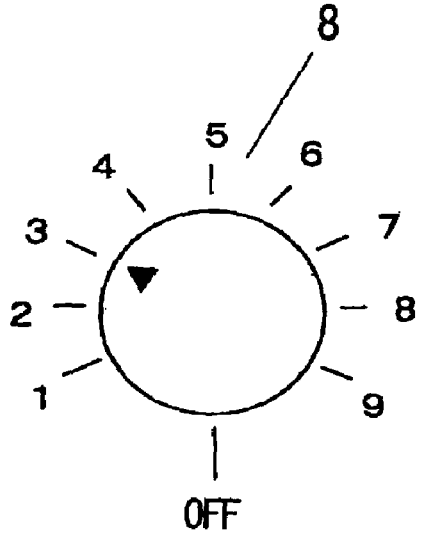
FIG. 3 is a front view of an example of a torque setter having a rotary switch and a dial thereof.
Figure 4:
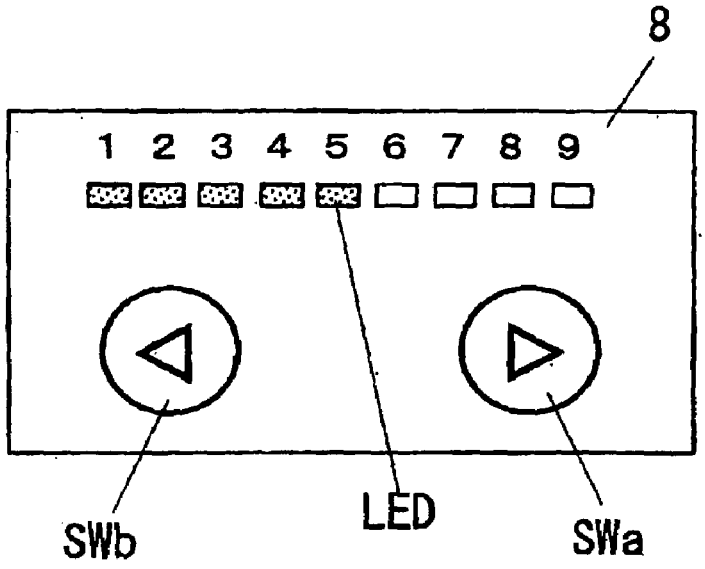
FIG. 4 is a front view of another example of the torque setter having an LED array as an indicator and two push switches.

FIGS. 3 and 4 respectively show examples of a front view of the torque setter 8. In the example shown in FIG. 3, the torque setter 8 has a rotary switch, a dial of the rotary switch and a switching circuit connected to the rotary switch for varying a level of an output signal corresponding to an indication position of the rotary switch. The values of the torque can be selected among nine levels designated by numerals 1 to 9 and switching off at which the value of torque becomes infinitely grate, corresponding to the position of the dial.

In the example shown in FIG. 4, the torque setter 8 has an LED array serving as an indicator for showing nine levels of the value of the torque, two push switches SWa and SWb and a switching circuit connected to the LEDs and the push switches SWa and SWb for varying a level of an output signal corresponding to pushing times of the push switches SWa and SWb or number of lit LEDs.

When the fastening member is made of a softer material or the size of the fastening member is smaller, the torque necessary for fastening the fastening member is smaller, so that it is preferable to set the reference value of the torque smaller. Alternatively, when the fastening member is made of harder material or the size of the fastening member is larger, the torque necessary for fastening the fastening member is larger, so that it is preferable to set the reference value of the torque larger. Consequently, it is possible to carry out the fastening operation suitably corresponding to the material or the size of the fastening member.

Figure 5:
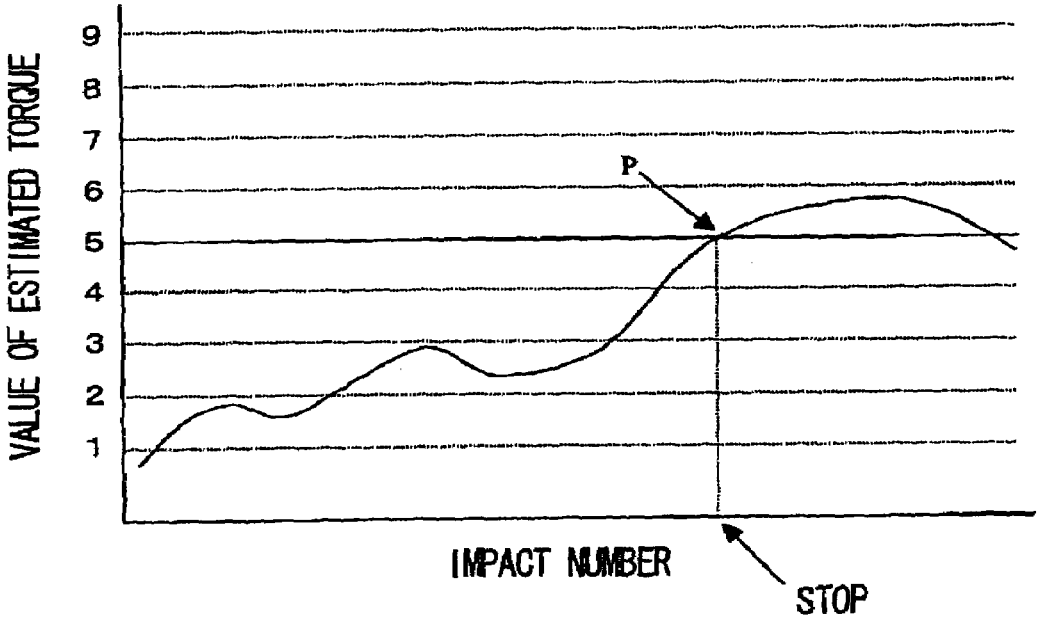
FIG. 5 is a graph showing an example of a relation between an impact number and variation of a value of an estimated torque, in which the reference value of the torque is increased linearly.

FIG. 5 shows a relation between the impact number of the hammer 2 and the value of the estimated torque. In FIG. 5, abscissa designates the impact number of the hammer 2, and ordinate designates the value of the estimated torque. In the example shown in FIG. 5, the reference values of the torque to be compared corresponding to the levels one to nine are set to increase linearly.

It is assumed that the reference value of the torque is set, for example, to be the level five in FIG. 3 or 4. When the impact starts, the value of the estimated torque gradually increases with a little variation. When the value of the estimated torque becomes larger than the reference value of the torque corresponding to the level five at a point P, the driving of the motor 1 is stopped. Since the value of the estimated torque includes fluctuation not a few, it is preferable to calculate the value of the estimated torque based on a moving average of the impact number.

Figure 6:
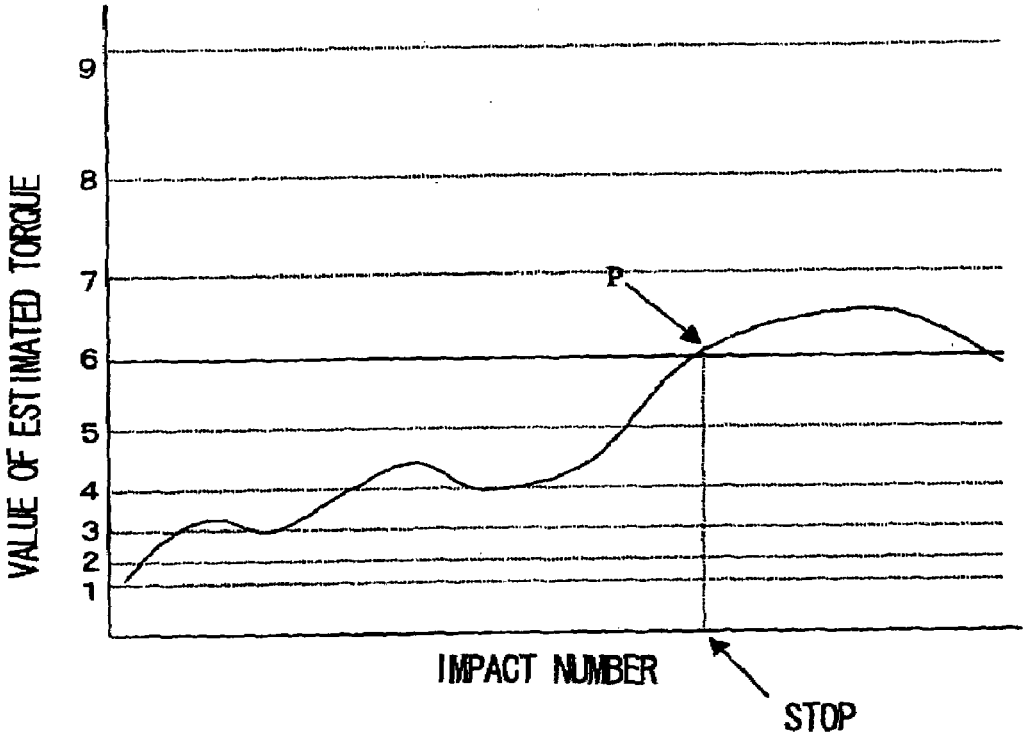
FIG. 6 is a graph showing another example of a relation between an impact number and variation of a value of an estimated torque, in which the reference value of the torque is increased nonlinearly.

It, however, is not limited to the example shown in FIG. 5. As shown in FIG. 6, it is possible to increase the reference value of the torque nonlinearly in a manner so that the larger the number of the level becomes, the larger the rate of increase of the reference value becomes. In the latter case, it is possible to adjust the torque for fastening the fastening member finely when the level of the reference value of the torque is lower corresponding to the fastening member made of softer material or smaller. Alternatively, it is possible to adjust the torque for fastening the fastening member roughly when the level of the reference value of the torque is higher corresponding to the fastening member made of harder material or larger.

FIG. 7 shows still another example of a front view of the torque setter 8. In the example shown in FIG. 7, the torque setter 8 has a first and a second rotary switches SW1 and SW2, two dials of the rotary switches and a switching circuit connected to the rotary switches SW1 and SW2 for varying a level of an output signal corresponding to the combination of the indication positions of the rotary switches SW1 and SW2 on the dials. The first rotary switch SW1 is used for selecting a kind of materials of a component to be fastened by the fastening member, and the second rotary switch SW2 is used for selecting the size of the fastening member. FIG. 8 shows a table showing an example of the levels of the reference value of the torque to be compared corresponding to the materials of the component to be fastened by the fastening member and the size of the fastening member. It is assumed that the user sets the first rotary switch SW1 to indicate the woodwork and the second rotary switch SW2 to indicate the size 25 mm. The switching circuit outputs a signal corresponding to the reference value of the torque at the level four.

Since the impact energy is generated at the moment when the hammer 2 impacts the anvil 30, it is necessary to measure the speed of the hammer 2 at the moment of the impact for obtaining the impact energy, precisely. The hammer 2, however, moves in the axial direction of the driving shaft 1, and the impulsive force acts on the hammer 2. Thus, it is very difficult to provide a rotary encoder or the like in the vicinity of the hammer 2. In this embodiment, the impact energy is calculated with basing on the average rotation speed of the driving shaft 11 of the motor 1. The impact mechanism of the hammer 2, however, is very complex due to the intervening of the spring 12. In case of using the average rotation speed ω simply, various errors occur when the rotation speed of the driving shaft 11 of the motor 1 becomes slower due to the dropout of the voltage of the battery 91 or while the rotation speed of the motor 1 is controlled in a speed control region of by the trigger switch 92, even though the value of the coefficient C1 is selected to be a suitable one experimentally obtained.

In the power impact tool in which the rotation speed of the motor 1 is varied, it is preferable to calculate the value of the estimated torque with using the following equation, in which a compensation function F(ω) of the average rotation speed ω instead of the above-mentioned coefficient C1.

$$T=(J\times F(\omega)\times\omega 2)/2\times\Delta r$$

Since the function F(ω) is caused by the impact mechanism, it can be obtained with using the actual tool, experimentally. For example, when the average rotation speed ω is smaller, the value of the function F(ω) becomes larger. The value of the estimated torque T is compensated by the function F(ω) corresponding to the value of the average rotation speed ω, so that the accuracy of the estimation of the torque for fastening the fastening member can be increased. Consequently, more precise fastening operation of the fastening member can be carried out.

It is assumed that the resolution of the frequency generator 5 serving as a rotation angle sensor is 24 pulses per one rotation, the reduction ratio K=8, and the hammer 2 can impact the anvil 30 twice per one rotation. When the output shaft 3 cannot be rotated at all at one impact of the hammer 2, the number of pulses in the output signal from the frequency generator 5 between two impacts of the hammer 2 becomes 96=(1/2)×8×24. When the output shaft 3 is rotated 90 degrees at one impact of the hammer 2, the number of pulses in the output signal from the frequency generator 5 between two impacts of the hammer 2 becomes 144=((1/2)+(1/4))×8×24. That is, the difference between the numbers of pulses 48=144−96 shows that the output shaft 3 has been rotated by 90 degrees. Hereupon, the relations between the rotation angles Δr of the fastening member and the numbers of pulses in the output signal from the frequency generator 5 become as follows. The rotation angles Δr becomes 1.875 degrees per one pulse, 3.75 degrees per two pulses, 5.625 degrees per three pulses, 45 degrees per twenty four pulses, and 90 degrees per fourth eight pulses.

Hereupon, it is further assumed that the torque necessary for fastening the fastening member is much larger. When the rotation angle Δr of the output shaft 3 is 3 degrees, the number of pulses in the output signal from the frequency generator 5 becomes one or two. The value of the estimated torque, however, is calculated by the above-mentioned equation, so that the value of the estimated torque when the number of pulses is one shows double larger than the value of the estimated torque when the number of pulses is two. That is, when the torque necessary for fastening the fastening member is much larger, a large accidental error component occurs in the value of the estimated torque. Consequently, the driving of the motor 1 could be stopped erroneously. If a frequency generator having a very high resolution were used for sensing the rotation angle of the output shaft, such the disadvantage could be solved. The cost of the power impact driver, however, became very expensive.

For solving the above-mentioned disadvantage, the fastening judger 7 of the power impact driver 1 in this embodiment subtracts a number such as 95 or 94 which is smaller than 96 from the number of pulses in the output signal from the frequency generator 5 in consideration of offset value, instead of the number of pulses (96 in the above-mentioned assumption) corresponding to the rotation of the hammer 2 between two impacts. When the number to be subtracted is selected as 94 (offset value is −2), the number of pulses corresponding to the rotation angle 3 degrees becomes three or four. In such the case, the value of the estimated torque corresponding to three pulses becomes about 1.3 times larger than the value of the estimated torque corresponding to four pulses. In comparison with the case in consideration of no offset value, the accidental error component in the value of the estimated torque becomes smaller. It is needless to say that the numerator of the above-mentioned equation for calculating the value of the estimated torque is compensated by multiplying two-fold or three-fold. When the rotation angle of the output shaft 3 is larger, the accidental error component due to the above-mentioned offset can be tolerated. For example, when the rotation angle of the output shaft 3 is 90 degrees, the number of pulses in the output signal from the frequency generator 5 becomes 48 without the consideration of the offset, and becomes 50 with the consideration of the offset.

It is possible that the motor controller 9 has a speed control function for controlling the rotation speed of the driving shaft 11 of the motor 1 (hereinafter, abbreviated as "rotation speed of the motor 1") corresponding to a stroke of the trigger switch 92. FIG. 9 shows a relation between the stroke of the trigger switch 92 and the rotation speed of the motor 1. In FIG. 9, abscissa designates the stroke of the trigger switch 92, and ordinate designates the rotation speed of the motor 1. A region from 0 to A of the stroke of the trigger switch 92 corresponds to a play in which the motor 1 is not driven. A region from A to B of the stroke of the trigger switch 92 corresponds to the speed control region in which the longer the stroke of the trigger switch 92 becomes, the faster the rotation speed of the motor 1 becomes. A region from B to C of the stroke of the trigger switch 92 corresponds to a top rotation speed region in which the motor 1 is driven at the top rotation speed.

Figure 10:
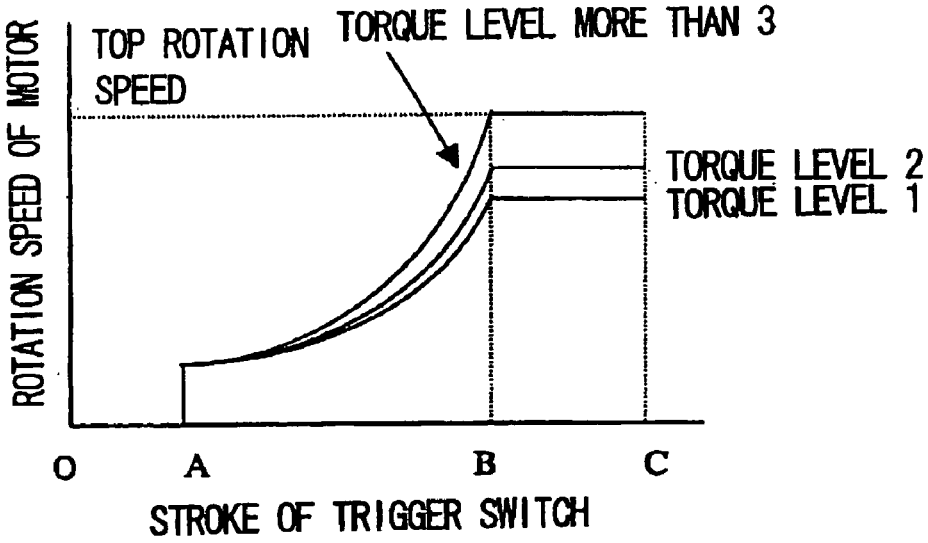
FIG. 10 is a graph showing another example of the relation between the rotation speed of the motor and the stroke of the trigger switch, in which a limit is put on a top rotation speed corresponding to the level of the reference value set in the torque setter.

In the speed control region, the rotation speed of the motor 1 can be adjusted finely in a low speed. It is preferable to put a limit on the rotation speed of the motor 1 corresponding to the value of the torque level set in the torque setter 8, further to the control of the rotation speed of the motor 1 corresponding to the stroke of the trigger switch 92, as shown in FIG. 10. Specifically, the lower the torque level set in the torque setter 8 is, the lower the limited top rotation speed of the motor 1 becomes, and the gentler the slope of the characteristic curve of the rotation speed of the motor 1 with respect to the stroke of the trigger switch 92 is made.

Since the power impact tool carries out the fastening operation of the fastening member at a high torque, it has an advantage that the time necessary for work operation is shorter. It, however, has a disadvantage that the power is too high to fasten the fastening member made of softer material or smaller, so that the fastening member or the component to be fastened by the fastening member will be damaged by the impact in several times. On the contrary, when the top rotation speed of the motor 1 is limited lower corresponding to the torque necessary for fastening the fastening member, it is possible to reduce the impact energy at the impact of the hammer 2 on the anvil 30. Thus, the fastening operation can suitably be carried out corresponding to the kind of the materials and/or sizes of the fastening member and the component to be fastened by the fastening member. If there were no impact of the hammer 2 on the anvil 30, it were impossible to estimate the torque for fastening the fastening member. Thus, the lower limit of the top rotation speed of the motor 1 is defined as the value at which the impact of the hammer 2 on the anvil 30 surely occurs.

Furthermore, it is possible that the torque level in the torque setter 8 is automatically set corresponding to the condition that the power impact tool is used. For example, when the torque level is initially set as level four, and the motor 1 is driven by switching on the trigger switch 92, the driving of the motor 1 is stopped when the calculated value of the estimated torque reaches to the value corresponding to the level four. Hereupon, when the trigger switch 92 is further switched on in a predetermined term (for example, one second), the fastening judger 7 shifts the torque level one step to level five, and restarts to drive the motor 1, and stops the driving of the motor 1 when the calculated value of the estimated torque reaches to the value corresponding to the level five. When the trigger switch 92 is still further switched on, the fastening judger 7 shifts the torque level one step by one, and restarts to drive the motor 1. When the torque level reaches to the highest, the fastening judger 7 continues to drive the motor 1 at the highest torque level.

Figure 11:
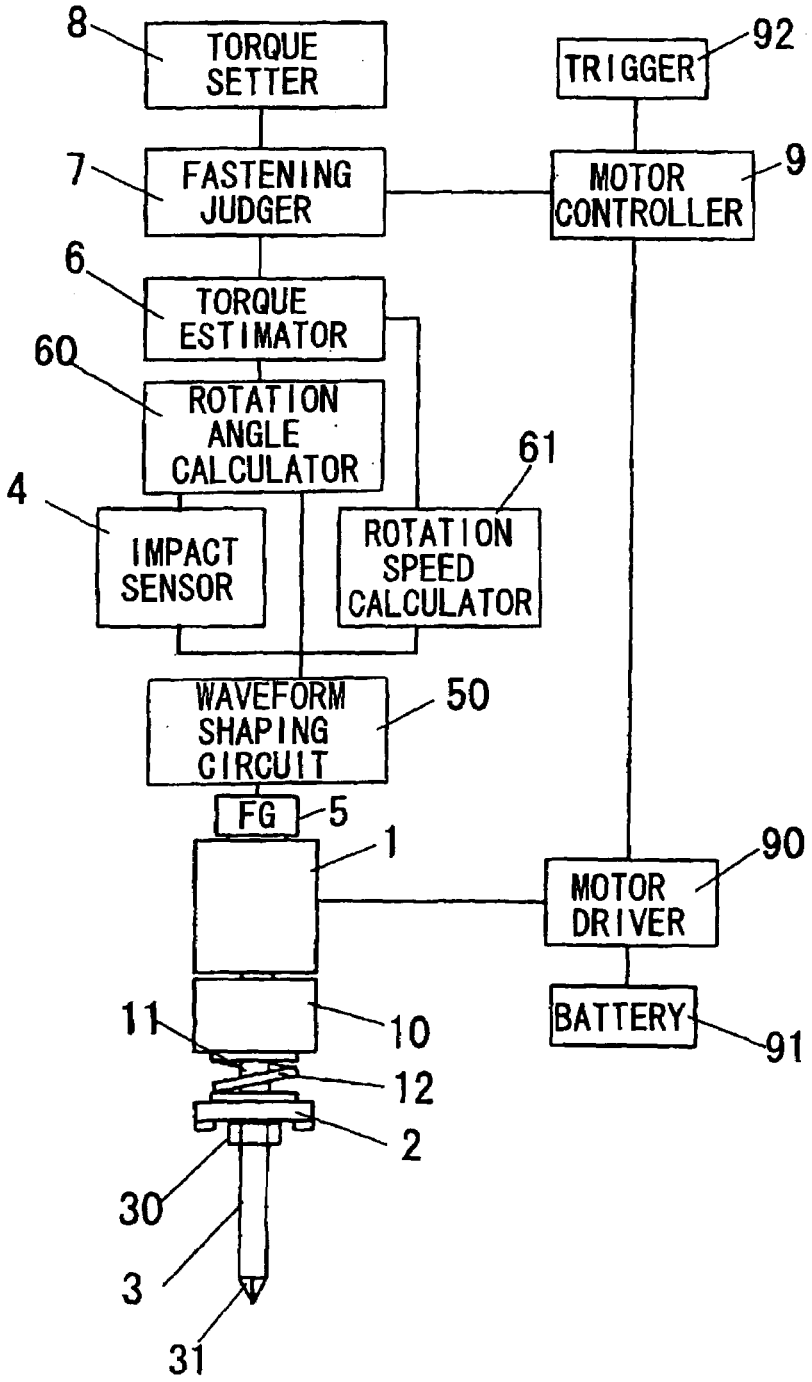
FIG. 11 is a block diagram showing another configuration of the power impact tool in accordance with the embodiment of the present invention.

FIG. 11 shows another configuration of the power impact tool in this embodiment. The output signal from the frequency generator 5 is inputted to the impact sensor 4 via the waveform shaping circuit 50. The frequency generator 5 is used not only as a part of the rotation speed sensor, but also as a part of the impact sensor instead of the microphone 40. Specifically, the rotation speed of the motor 1 is reduced a little due to load fluctuation when the hammer 2 impacts the anvil 30, and the pulse width of the frequency signal outputted from the frequency generator 5 becomes a little wider. The impact sensor 4 senses the variation of the pulse width of the frequency signal as the occurrence of the impact. Furthermore, it is possible to use an acceleration sensor for sensing the occurrence of the impact of the hammer 2 on the anvil 30.

Figure 12:
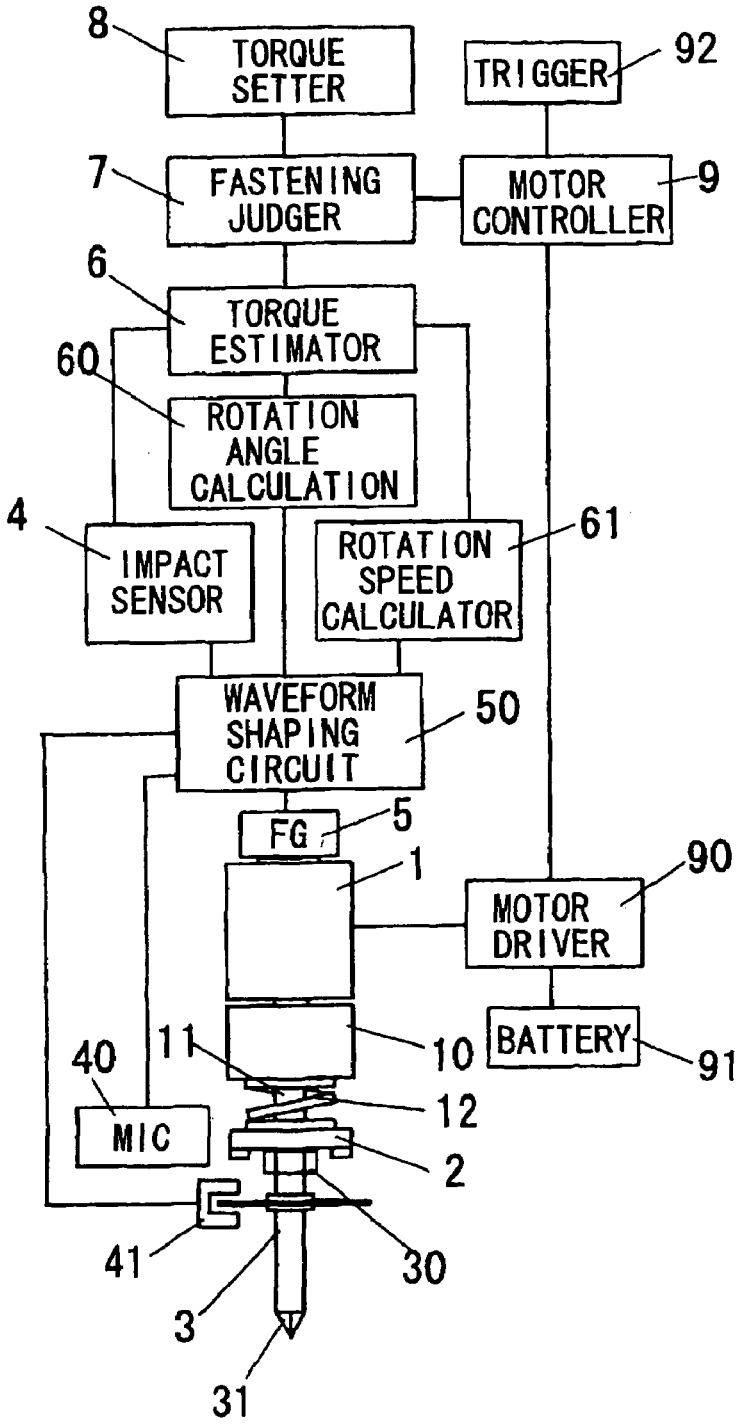
FIG. 12 is a block diagram showing still another configuration of the power impact tool in accordance with the embodiment of the present invention.

FIG. 12 shows still another example of a configuration of the power impact tool in this embodiment. The power impact tool further comprises a rotary encoder 41 serving as a rotation angle sensor for sensing the rotation angle of the output shaft 3, directly. Still furthermore, it is preferable to inform that the driving of the motor 1 is stopped when the value of the estimated torque reaches to a predetermined reference value by a light emitting device or an alarm. By such a configuration, the user can distinguish the normal stopping of the motor 1 from the abnormal stopping of the motor 1 due to trouble.

In the above-mentioned description, the motor 1 is used as a driving power source. The present invention, however, is not limited the description or drawing of the embodiment. It is possible to use another driving source such as a compressed air, or the like.

This application is based on Japanese patent application 2003-354197 filed Oct. 14, 2003 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A power impact tool comprising:

a hammer;

a driving mechanism for rotating the hammer around a driving shaft;

an output shaft to which a rotation force owing to an impact of the hammer is applied;

an impact sensor for sensing occurrence of the impact of the hammer;

a rotation speed sensor for sensing a rotation speed of the driving shaft with using a rotation angle of the driving shaft;

a rotation angle sensor for sensing a rotation angle of the output shaft in a term from a time when the impact sensor senses an occurrence of the impact of the hammer to another time when the impact sensor senses a next occurrence of the impact of the hammer;

a torque estimator for calculating an impact energy with using an average rotation speed of the driving shaft sensed by the rotation speed sensor, and for calculating a value of estimated torque for fastening a fastening member which is given as a division of the impact energy by the rotation angle of the output shaft;

a torque setter for setting a reference value of torque to be compared; and a controller for stopping the rotation of the driving shaft when the value of the estimated torque becomes equal to or larger than a predetermined reference value set by the torque setter.

2. The power impact tool in accordance with claim 1, wherein:

the rotation angle sensor calculates the rotation angle of the output shaft with using the rotation angle of the driving shaft sensed by the rotation angle sensor.

3. The power impact tool in accordance with claim 1, wherein:

the torque estimator compensates the value of the impact energy corresponding to the value of the average rotation speed of the driving shaft when the impact energy is calculated with using the average rotation speed.

4. The power impact tool in accordance with claim 1, wherein:

the torque estimator adds a predetermined offset value to the value of the rotation angle sensed by the rotation angle sensor when the value of the estimated torque is calculated.

5. The power impact tool in accordance with claim 1, wherein:

the torque setter has a plurality of levels of the reference values which are selected by a user, and the reference values are nonlinearly increased in a manner so that the higher the level becomes, the larger the increase of the value becomes.

6. The power impact tool in accordance with claim 1, wherein:

the torque setter has a size selector for selecting a size of the fastening member among a plurality of sizes previously set and a kind selector for selecting a kind of a component to be fastened by the fastening member among a plurality of kinds previously selected, and the reference value is selected among a plurality of values corresponding to a combination of the size of the fastening member and the kind of the component to be fastened.

7. The power impact tool in accordance with claim 1, wherein:

a trigger switch is further comprised for switching on and off the rotation of the driving shaft of the driving mechanism and for varying the rotation speed of the driving shaft corresponding to a stroke of the trigger switch operated by a user; and the controller puts a limit on the rotation speed of the driving shaft of the driving mechanism with no relation to a stroke of the trigger switch, when the reference value set in the torque setter is smaller than a predetermined level.

8. The power impact tool in accordance with claim 7, wherein:

the limit on the rotation speed of the driving shaft is faster than a lower limit at which the impact of the hammer can occur.

9. The power impact tool in accordance with claim 1, wherein:

a trigger switch is further comprised for switching on and off the rotation of the driving shaft of the driving mechanism and for varying the rotation speed of the driving shaft corresponding to a stroke of the trigger switch operated by a user; and the controller stops the driving of the driving mechanism when the value of the estimated torque calculated by the torque estimator becomes equal to or larger than the reference value set in the torque setter, and restarts the driving of the driving mechanism with shifting the torque level one step higher when the trigger switch is further switched in a predetermined term after stopping the driving of the driving mechanism.

* * * * *